US005384583A

United States Patent [19]

Katerberg et al.

[11] Patent Number: 5,384,583

[45] Date of Patent: Jan. 24, 1995

[54] INK JET STIMULATION MONITORING

[75] Inventors: James A. Katerberg, Kettering; Mark C. Bowers, Vandalia, both of Ohio

[73] Assignee: Scitex Digital Printing, Inc., Dayton, Ohio

[21] Appl. No.: 61,148

[22] Filed: May 12, 1993

[51] Int. Cl.[6] ..... B41J 2/025

[52] U.S. Cl. ..... 347/19

[58] Field of Search ..... 346/75

[56] References Cited

U.S. PATENT DOCUMENTS 4,473,830 9/1984 Piatt et al. ..... 346/75

4,631,549 12/1986 Braun et al. ..... 346/75 X 4,897,666 1/1990 Katerberg et al. ..... 346/75 X

*Primary Examiner*—George H. Miller, Jr.

*Attorney, Agent, or Firm*—Barbara Joan Haushalter

[57] ABSTRACT

An ink jet printing device has a drop generator for producing continuous streams of ink drops from at least one orifice and further has stimulation control electronics for maintaining desired stimulation conditions in response to a feedback from the drop generator. First and second feedback transducers measure the stimulation amplitude in the drop generator and generate feedback output signals in response to the stimulation. The feedback output signals are approximately equal in magnitude and opposite in sign to each other when the stimulation amplitude in the drop generator is a desired stimulation mode. An amplifier, whose inputs are the feedback output signals, provides an amplifier output signal to the stimulation control electronics which is the difference between the two feedback output signals.

18 Claims, 2 Drawing Sheets

INK JET STIMULATION MONITORING

TECHNICAL FIELD

The present invention relates to ink jet printing systems and, more particularly, to an improved means for monitoring the stimulation in the drop generator of an ink jet printing system.

BACKGROUND ART

In continuous ink jet printing, graphic reproduction is accomplished by selectively charging and deflecting drops from the drop streams and depositing at least some of the drops on a print receiving medium while other of the drops strike a drop catcher device. In order to provide precise charging and deflecting of the drops, it is important that the drop break-up process produce uniformly sized and timed drops. Drop generators for such printers produce the required drop formation by vibrating the orifices from which the ink emerges.

In U.S. Pat. No. 4,473,830, a feedback transducer was utilized for monitoring the vibration amplitude. The drive amplitude for the drop generator was servo controlled to maintain the proper feedback amplitude. Copending, commonly assigned U.S. patent application Ser. Nos. 796,490 and 858,796, filed Nov. 22, 1991, and Mar. 27, 1992, respectively, incorporated herein by reference, further employ this feedback signal to insure that the drive signal tracks the resonance of the drop generator and to provide the proper phasing of the drop charging electronics with respect to the stimulation.

These stimulation control means function appropriately when the feedback signal has a sufficient signal-to-noise ratio. In the field of ink jet printers, however, it is desirable from the standpoint of throughput to utilize long arrays of ink jets. Unfortunately, the signal-to-noise ratio tends to be degraded in ink jet printers having long arrays and high resonant frequency. Long arrays of jets have more charging electrodes which must be rapidly switched between ground potential and high voltage. These switching transients produce electrical noise which can be picked up at the input to the stimulation control electronics. Even with careful shielding and filtering, the electrical noise picked up by the stimulation control electronics can affect the stimulation drive amplitude and frequency. Higher frequency drop generators tend to have lower feedback signal amplitudes, further reducing the signal-to-noise ratio.

It is seen then that there is a need for a means of improving the signal-to-noise ratio of the feedback signal used by the stimulation control electronics.

SUMMARY OF THE INVENTION

This need is met by the stimulation monitoring means of the present invention wherein a means is provided to improve the signal-to-noise of the feedback signal used by the stimulation control electronics. One important object of the present invention is to provide an improved ink jet printing device having means for maintaining the desired stimulation conditions.

In accordance with one aspect of the present invention, an ink jet printing device has a drop generator for producing continuous streams of ink drops from at least one orifice and further has stimulation control electronics for maintaining desired stimulation conditions in response to a feedback from the drop generator. First and second feedback transducers measure the stimulation amplitude in the drop generator and generate feedback output signals in response to the stimulation. The feedback output signals are approximately equal in magnitude and opposite in sign to each other when the stimulation amplitude in the drop generator is a desired stimulation mode. An amplifier, whose inputs are the feedback output signals, provides an amplifier output signal to the stimulation control electronics which is the difference between the two feedback output signals.

Accordingly, it is an advantage of the present invention that it provides stimulation monitoring for a drop generator of an ink jet printing system. Other objects and advantages of the invention will be apparent from the following description, the accompanying drawing and the appended claims.

DETAILED DESCRIPTION OF THE PREFERRED EMBODIMENTS

Figure 1:
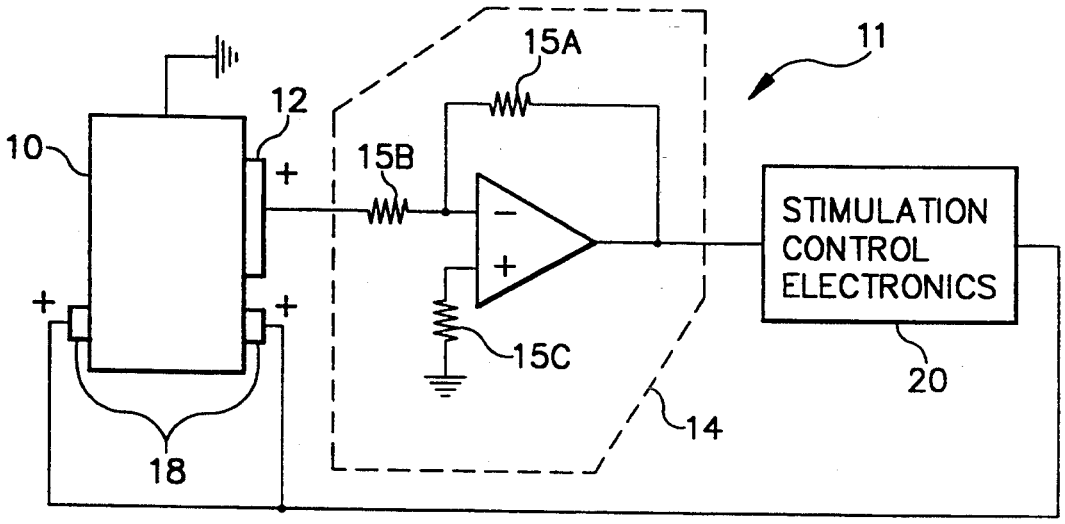
FIG. 1 PRIOR ART
FIG. 1 illustrates a schematic of a prior art means for monitoring and controlling the vibration of a drop generator.

Referring to the drawings, FIG. 1 schematically illustrates a prior art monitoring and controlling means 11 for monitoring and controlling the vibration of a drop generator 10. The monitoring and controlling means 11 comprises a piezoelectric element 12 bonded to the drop generator 10 for detecting the vibration amplitude of the drop generator 10. Output 11, typically from the positive poled face, is provided to buffer amplifier 14. The buffer amplifier 14 is typically located near the drop generator 10 to minimize signal attenuation in the cabling and to minimize noise pick-up. The buffer amplifier 14 includes resistors 15*a*, 15*b*, and 15*c*, which are typically on the order of 100 KΩ, 56 KΩ, and 33 KΩ, respectively. The buffer amplifier 14 output is provided to stimulation control electronics 20. The stimulation control electronics 20 utilizes the amplified feedback signal as the controlling input for frequency and amplitude control of a stimulation driving signal. The driving signal is applied to driving piezoelectric elements 18, causing the drop generator 10 to vibrate.

Figure 2:
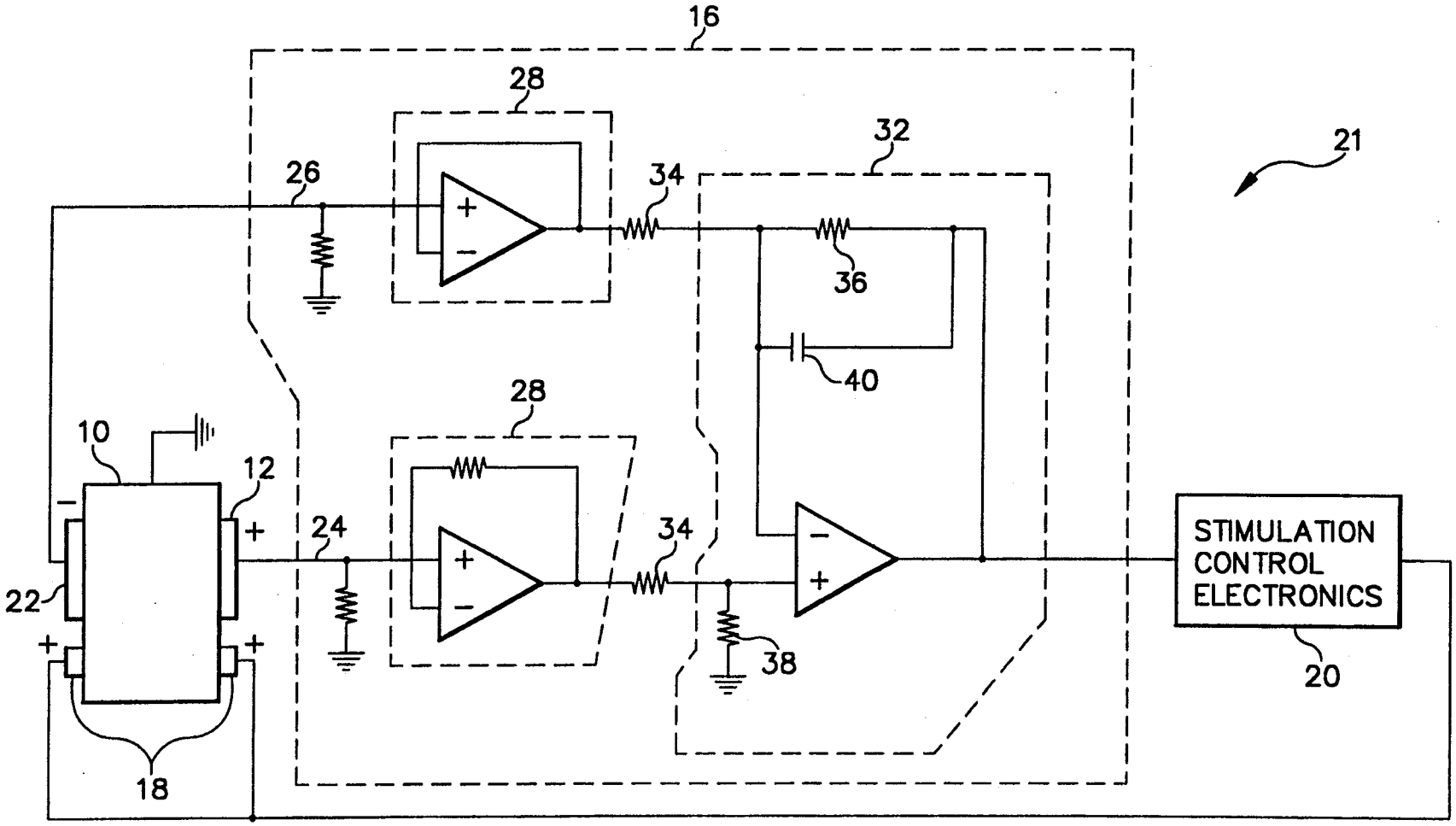
FIG. 2 illustrates a schematic of a means for monitoring and controlling the stimulation of a drop generator, in accordance with the present invention.

Referring now to FIG. 2, a means 21 for monitoring and controlling the stimulation of the drop generator 10, in accordance with the present invention, is illustrated, incorporating a differential buffer amplifier means 16. The drop generator 10 is preferably a resonant body type drop generator, although it will be obvious to those skilled in the art that the concept of the present invention may be applied to other drop generators, such as piston type drop generators or traveling wave type drop generators.

Continuing with FIG. 2, stimulation control electronics 20 utilizes the feedback signal which is output from the differential buffer amplifier 16 as the controlling input for control of the stimulation frequency and amplitude. The output of the stimulation control electronics 20 drives the piezoelectric elements 18 which cause the drop generator 10 to be stimulated. With a resonant body type drop generator 10, the stimulation comprises a vibrational displacement of the resonant body type drop generator.

As can be seen in FIGS. 1 and 2, the present invention differs from the prior art in the manner in which the feedback signal is generated. The present invention utilizes two feedback elements 12 and 22. In a preferred embodiment of the present invention, the two feedback elements 12 and 22 are typically piezoelectric elements, since piezoelectric elements produce a voltage between their electrodes in response to an applied strain. Of course, the piezoelectric elements are marked by the vendor to indicate which electrode has the positive potential with respect to the other electrode in response to given stress.

Continuing with FIG. 2, piezoelectric element 12 is bonded to the drop generator 10 such that its negative electrode is grounded to the drop generator 10 and its positive electrode is used as a positive input 24 to the differential buffer amplifier 16. Piezoelectric element 22 is bonded to the drop generator 10 with its positive electrode grounded to the drop generator 10 and its negative electrode being used as a negative input 26 to the differential buffer amplifier 16.

Since the feedback signal from piezoelectric element 22 has a similar magnitude but opposite sign to the signal from piezoelectric element 12, the difference between the signals from 12 and 22 is approximately twice the amplitude of the signal from piezoelectric element 12. The electronic noise that is picked up will have similar sign and magnitude at the inputs 24 and 26 of the differential buffer amplifier 16. The output from the differential buffer amplifier will therefore have most of the noise eliminated, as the noise signal at input 26 will be subtracted from the noise signal at input 24. In this way, the use of two feedback crystals in a push-pull, or positive poled-negative poled configuration coupled with the differential buffer amplifier 16 increases the signal-to-noise ratio of the feedback signal, thereby reducing the effects of the electronic noise.

In the embodiment of the present invention illustrated in FIG. 2, the inputs 24 and 26 each incorporate voltage follower amplifier 28 to provide high impedance to the feedback crystals 12 and 22. In a preferred embodiment, a high impedance, on the order of 200 KΩ, shunt to ground is also incorporated into the inputs. These high impedance shunts 30 provide a discharge path for any DC potential which may develop across the crystals. The shunt can be any suitable shunt, including a simple resistor or a complex element where its impedance is less for DC than at the fundamental frequency of the output of the crystal. Without the high impedance shunts, DC potentials developed across the piezoelectric elements 12 and 22 due to thermal expansion of the drop generator 10 can saturate the amplifiers to a high DC level, resulting in improper stimulation frequency and amplitude. The outputs of voltage follower amplifier 28 are input into plus and minus inputs of the differential amplifier 32. The circuit 21 may include additional components, as needed, such as resistors 34, having values typically on the order of 10 KΩ; resistors 36 and 38, each having values typically on the order of 20 KΩ; and capacitor 40, used to prevent oscillations, and having a value typically on the order of 20 KF.

It is noted that the differential buffer amplifier 16 may be incorporated into the same electronics board as the stimulation control electronics, or may be located remote from the stimulation control electronics, without departing from the spirit and scope of the invention. In a preferred embodiment, the differential buffer amplifier 16 is located on an electronics board situated proximate to the drop generator 10. The outputs from the piezoelectric elements 12 and 22 are connected via a twisted pair of shielded cable to the differential buffer amplifier 16. A power amplifier (not shown) may be utilized at the output of the differential buffer amplifier 16 to drive a long cable to the stimulation control electronics 20.

In a preferred embodiment of the present invention, the feedback elements 12 and 22 should be located proximate to each other so that noise picked up on their outputs will be similar. It may also be desirable to symmetrically place the feedback elements around a symmetry axis of the resonator to suppress detection of asymmetric resonant modes of the drop generator. An asymmetric mode is one in which one side of the resonator is in expansion while the other side is in contraction. For such a mode, the feedback element in expansion would output a positive voltage. The symmetrically placed feedback element would undergo contraction. Because the second feedback element is oppositely poled, it would also output a positive voltage. The resulting output from the differential buffer amplifier 16 would therefore be near zero. By suppression of the detection of such modes, the stimulation control electronics 20 can be prevented from inappropriately tracking such undesired resonances.

Industrial Applicability and Advantages

The present invention is useful in the field of ink jet printing, and has the advantage of improving stimulation monitoring in ink jet printing systems. The present invention has the further advantage of improving signal monitoring by increasing the signal level and decreasing the noise of the system. Finally, the present invention has the advantage of providing a means of reducing the sensitivity of stimulation control electronics to undesired resonances.

The invention has been described in detail with particular reference to certain preferred embodiments thereof, but it will be understood that modifications and variations can be effected within the spirit and scope of the invention.

We claim:

1. An ink jet printing device having a drop generator for producing continuous streams of ink drops from at least one orifice and further having stimulation control electronics for maintaining desired stimulation conditions in response to a feedback from the drop generator, the device comprising:

a. first and second feedback elements for measuring stimulation amplitude in the drop generator;

b. feedback output signals generated by the first and second feedback elements in response to the stimulation amplitude in the drop generator; and c. amplifier means having an input provided by the feedback output signals generated by the first and second feedback elements, the amplifier means for providing an amplifier output signal to the stimulation control electronics.

2. An ink jet printing device as claimed in claim 1 wherein stimulation comprises a vibrational displacement of a resonant body type drop generator.

3. An ink jet printing system as claimed in claim 2 wherein the amplifier output signal is utilized by the stimulation control electronics for amplitude and frequency control of a stimulation driving signal applied to driving elements to cause the drop generator to vibrate.

4. An ink jet printing device as claimed in claim 1 wherein the feedback output signals are approximately equal in magnitude and opposite in sign to each other in response to the stimulation amplitude in the drop generator in a desired stimulation mode.

5. An ink jet printing device as claimed in claim 1 wherein the amplifier output signal is indicative of a difference between the two feedback output signals.

6. An ink jet printing device as claimed in claim 1 wherein the first and second feedback elements comprise piezoelectric elements.

7. An ink jet printing system as claimed in claim 1 wherein the first and second feedback elements are used in a push-pull configuration.

8. An ink jet printing system as claimed in claim 1 wherein the first and second feedback elements are located to suppress the amplifier output signal from undesirable vibrational stimulation modes.

9. An ink jet printing system as claimed in claim 1 wherein the amplifier means provides a high impedance shunt to ground on its inputs.

10. A method for monitoring stimulation in a drop generator of an ink jet printing system, the drop generator for producing continuous streams of ink drops from at least one orifice, the ink jet printing system having stimulation control electronics for maintaining desired stimulation conditions in response to a feedback from the drop generator, the method comprising the steps of:

a. measuring stimulation amplitude in the drop generator using first and second feedback elements;

b. generating feedback output signals from the first and second feedback elements in response to the stimulation amplitude in the drop generator; and c. providing an amplifier output signal to the stimulation control electronics using an amplifier means having an input provided by the feedback output signals generated by the first and second feedback elements.

11. A method for monitoring stimulation as claimed in claim 10 wherein stimulation comprises a vibrational displacement of a resonant body type drop generator.

12. A method for monitoring stimulation as claimed in claim 11 wherein the amplifier output signal is utilized by the stimulation control electronics for amplitude and frequency control of a stimulation driving signal applied to driving elements to cause the drop generator to vibrate.

13. A method for monitoring stimulation as claimed in claim 10 wherein the feedback output signals are approximately equal in magnitude and opposite in sign to each other in response to the stimulation amplitude in the drop generator in a desired stimulation mode.

14. A method for monitoring stimulation as claimed in claim 10 wherein the amplifier output signal is indicative of a difference between the two feedback output signals.

15. A method for monitoring stimulation as claimed in claim 10 wherein the first and second feedback elements comprise piezoelectric elements.

16. A method for monitoring stimulation as claimed in claim 10 further comprising the step of improving signal-to-noise ratio of the feedback output signals by using the first and second feedback elements in a push-pull configuration.

17. A method for monitoring stimulation as claimed in claim 10 wherein the first and second feedback elements are located to suppress the amplifier output signal from undesirable vibrational stimulation modes.

18. A method for monitoring stimulation as claimed in claim 10 wherein the amplifier means provides a high impedance shunt to ground on its inputs.

* * * * *